US006039635A

United States Patent [19]

Mitsuhashi et al.

[11] Patent Number: 6,039,635

[45] Date of Patent: Mar. 21, 2000

[54] SURFACE POLISHING APPARATUS INCLUDING A DRESSER

[75] Inventors: Masashige Mitsuhashi; Kenichi Ohno; Kenichi Yoshida, all of Tokyo, Japan

[73] Assignee: NEC Corporation, Tokyo, Japan

[21] Appl. No.: 09/141,421

[22] Filed: Aug. 27, 1998

[30] Foreign Application Priority Data

Aug. 29, 1997 [JP] Japan ..... 9-234512

[51] Int. Cl.[7] ..... B24B 7/04

[52] U.S. Cl. ..... 451/72; 451/288; 451/443

[58] Field of Search ..... 451/287, 36, 285, 451/41, 286, 288, 290, 56, 72, 443

[56] References Cited

U.S. PATENT DOCUMENTS 5,584,749 12/1996 Mitsuhashi et al. ..... 451/285
5,651,725 7/1997 Kikuta et al. ..... 451/41

FOREIGN PATENT DOCUMENTS 4-33336 2/1992 Japan .
5-69310 3/1993 Japan .
5-309559 11/1993 Japan .
8-192361 7/1996 Japan .

*Primary Examiner*—Timothy V. Eley
*Attorney, Agent, or Firm*—Whitham, Curtis & Whitham

[57] ABSTRACT

A surface polishing apparatus which presses a work piece 12 into contact with the processing surface of a disk-shaped polishing tool 11 which is rotated and driven, to polish the surface of the work piece 12 as supplying abrasive slurry to the processing surface. The surface polishing apparatus includes an abrasive slurry-supply mechanism 13 which supplies abrasive slurry to the processing surface. The slurry supply mechanism is provided on the backward side of the work piece with respect to the rotation direction of the polishing tool. A dresser 23, which sets the processing surface, is provided on the forward side of the work piece an abrasive slurry-suction mechanism, which sucks and recycles abrasive slurry from the processing surface, is provided on the forward side of the dresser and on the backward side of abrasive slurry-supply mechanism 13.

13 Claims, 4 Drawing Sheets

SURFACE POLISHING APPARATUS INCLUDING A DRESSER

BACKGROUND OF THE INVENTION

1. Field of the Invention

The present invention relates to a surface polishing apparatus for highly smoothly polishing the surfaces of semiconductor wafers, wafers with semiconductor-IC covered with insulator films, wafers with metal wirings, magnetic disks, glass substrates, and other plate-shaped work pieces.

2. Description of the Related Art

Recently, surface polishing apparatuses described in Japanese Patent Laid-open Publication Nos. Hei4-33336, Hei5-69310, and Hei5-309559 have been utilized to polish semiconductor wafers, magnetic disks, etc.

FIG. 8 shows an example of the conventional surface polishing apparatuses similar to that in the above-mentioned patent publications. The present surface polishing apparatus presses a work piece 132, using a pressure-retainer plate 133, into contact with the upward processing surface of a disk-shaped polishing tool 131 which is driven rotationally, to polish the surface of the work piece 132 as supplying abrasive slurry 134 to the processing surface.

The above-mentioned conventional polishing apparatus, however, generates clogging in the processing surface as time passes in polishing, resulting in a deterioration in the polishing rate (ie., amount of polishing/time) and fluctuations in the amount of polishing for each work piece. Moreover, the abrasive slurry has to be drained each time a work piece is polished, increasing the running cost.

To overcome these problems, the present applicant has invented such a surface polishing apparatus as described in Japanese Patent Laid-open publication No. Hei 8-192361. The present surface polishing apparatus, which presses a work piece into contact with the processing surface of a rotationally-driven disk-shaped polishing tool in order to polish the processing surface as supplying abrasive slurry to the processing surface, is provided, on the backward side of the work piece with respect to the rotation direction of the above-mentioned polishing tool, with an abrasive slurry-supply mechanism which supplies abrasive slurry to the above-mentioned processing surface and also, on the forward side in rotation of the work piece, with an abrasive slurry-suction mechanism which sucks and recycles the abrasive slurry drained from the above-mentioned processing surface. The present apparatus, to improve the suction efficiency, has a brush mounted on the abrasive slurry-suction mechanism, so that the brush may turn up polish chips etc. existent in depressions in the processing surface.

In practice, however, despite its remarkable effects that the conventionally apparatuses do not have, the apparatus according to the present invention still cannot sufficiently eliminate clogging in the processing surface. That is, in contrast to the case where a lower pressure is applied to the work piece, in the case of a higher pressure, more clogging may develop.

SUMMARY OF THE INVENTION

It is accordingly an object of the present invention to provide such improved surface polishing apparatus that can significantly eliminate clogging in the processing surface and also gain a constant amount of polishing for each work piece at a high polishing rate irrespective of the pressure applied to the work piece.

To achieve the above-mentioned object, there is provided according to an aspect of the invention a surface polishing apparatus which presses a work piece into contact with the processing surface of a disk-shaped polishing tool which is driven to rotate, to polish the surface of the work piece as supplying abrasive slurry to the processing surface, wherein an abrasive slurry-supply mechanism, which supplies abrasive slurry is arranged on a backward side of the work piece as against the rotation direction of the disk-shaped polishing tool; and a dresser which sets the processing surface is arranged on the forward side of the work piece; and also an abrasive slurry-suction mechanism which sucks and recycles abrasive slurry from the processing surface is arranged on the forward side of the dresser and the backward side of the abrasive slurry-supply mechanism.

In the foregoing aspect, abrasive slurry supplied to the processing surface of a polishing tool by an abrasive slurry-supply mechanism is used to polish a work piece and then turned up, by a dresser which sets the processing surface, from the processing surface and then is immediately sucked by an abrasive slurry-suction mechanism. In this case, instead of a brush a dresser is used to set the processing surface, so that even with a higher pressure applied, used abrasive slurry containing polish chips and polishing-tool chips may be so turned up as to be sucked easily and completely. With the foregoing construction, the abrasive slurry can be immediately removed together with polish chips and polish tool chips from the processing surface, to present the clogging of the polishing tool surface and also to always keep the processing surface clean. Therefore, even when a high pressure is applied to a work piece for a long polishing time, it is possible to inhibit variations in the amount of polishing for each work piece.

In the foregoing, a mode is preferable in which the abrasive slurry-supply mechanism, the abrasive slurry-suction mechanism and the dresser subject an entire extent of the tool radius of the disk-shaped polishing tool to abrasive slurry supply, abrasive slurry suction, and setting respectively. With the present mode, work pieces can be polished with higher processing accuracy and efficiency under the same conditions, irrespective of the size of the work pieces.

Also, a mode is preferable in which the abrasive slurry-suction mechanism comprises a larger number of abrasive slurry-suction pores in an abrasive slurry-suction surface which faces inner and outer peripheries of the disk-shaped polishing tool than in a middle portion between the inner periphery and the periphery. With the present mode, the abrasive slurry and the polish chips which tend to gather at the inner and outer peripheries within the processing radius of the polishing tool can be sucked and collected efficiently.

Also, a mode is desirable in which the abrasive slurry-suction mechanism comprises shallow trenches which capture abrasive slurry, in an outer margin of an abrasive slurry-suction surface which faces the disk-shaped polishing tool. With the present mode, abrasive slurry which tends to flow toward the outer periphery of the polishing tool by the centrifugal force can be captured by shallow trenches provided in the outer margin of the abrasive slurry-suction surface, to be sucked efficiently.

Also, a mode is preferable in which the abrasive slurry-suction mechanism comprises a rounding or a chamfer at an outermost margin of an abrasive slurry-suction surface which faces the disk-shaped polishing tool. According to the present mode, it is possible to prevent damages of the polishing tool and the abrasive slurry-suction mechanism even if they should come in contact with each other during polishing.

Also, a mode is preferable in which the dresser has such a structure that a plurality of small diamond grindstones each of which is a mixture of natural diamond and artificial diamond grits are locked in a circle on the disk-shaped board, so that the plurality of small diamond grindstones may be pressed and held in contact with the disk-shaped polishing tool to set the processing surface of the disk-shaped polishing tool by rotating the disk-shaped board. According to the present mode, the effect of setting the polishing tool surface can be improved, to lower the dresser cost.

Also, a mode is preferable in which the dresser is supported rotationally on the processing surface of the disk-shaped polishing tool, to be rotated on its axis at a home position by friction due to rotation of the disk-shaped polishing tool. With the present mode, a rotary-drive mechanism for the dresser can be omitted.

Also, a mode is desirable in which the dresser is forced to rotate on the processing surface of the disk-shaped polishing tool by a rotary-drive mechanism. According to the present mode, it is possible to easily control the degree of setting by the dresser.

In addition, a mode is preferable in which the dresser comprises cylinder-shaped diamond grindstones each of which has a mixture of natural diamond and artificial diamond grits, which cylinder-shaped diamond grindstones are arranged so that the cylinder-shaped diamond grindstones may axially be aligned approximately with a radial direction of the disk-shaped polishing tool and, at the same time, be held in contact with the processing surface of the disk-shaped polishing tool when being rotated in a direction opposite to a rotation direction of the disk-shaped polishing tool, to set the processing surface of the disk-shaped polishing tool.

According to the present mode, the dresser can be compact in space, so that a plurality of work pieces can be placed on the processing surface of the polishing tool and efficiently polished simultaneously for a long time without lowering the polishing rate.

Furthermore, a mode is preferable in which a pressure-application mechanism which presses the cylinder-shaped diamond grindstones into contact with the processing surface of the disk-shaped polishing tool is arranged at both axial ends of each of the cylinder-shaped diamond grindstones.

According to the present mode, the radial contact pressure between the dresser and the polishing tool can be determined appropriately, to further improve the effects of setting for the polishing tool.

BRIEF DESCRIPTION OF THE DRAWINGS

The above and other objects, advantages, and features of the present invention will be more apparent from the following description taken in conjunction with the accompanying drawings, in which.

DESCRIPTION OF THE PREFERRED EMBODIMENTS

The following will explain the preferred embodiments of the present invention with reference to the accompanying drawings.

FIRST EMBODIMENT

Figure 1:
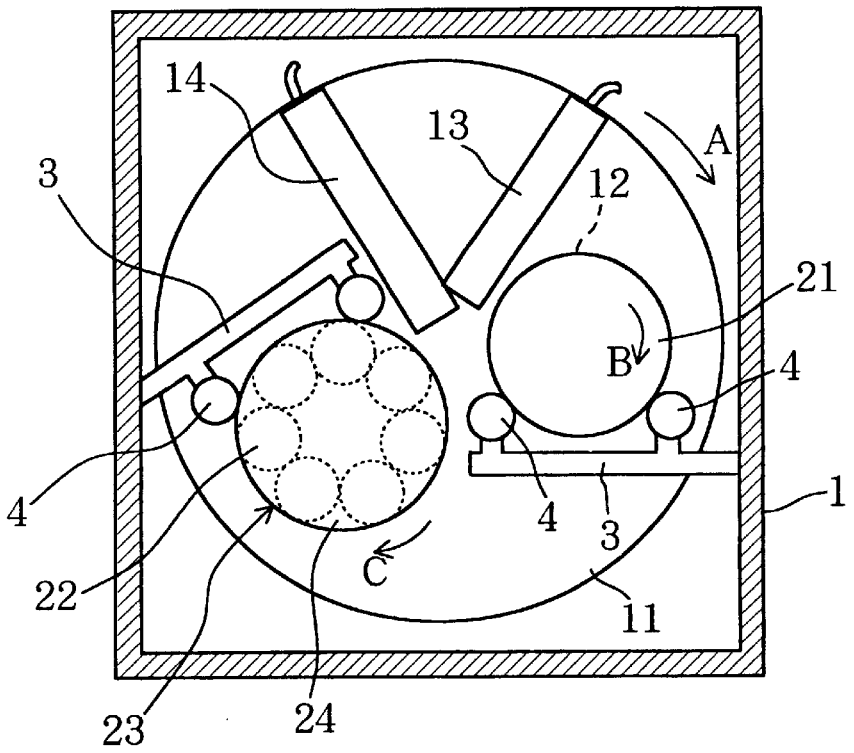
FIG. 1 is a plan view of the construction of a surface polishing apparatus according to the first embodiment of the present invention.
Figure 2:
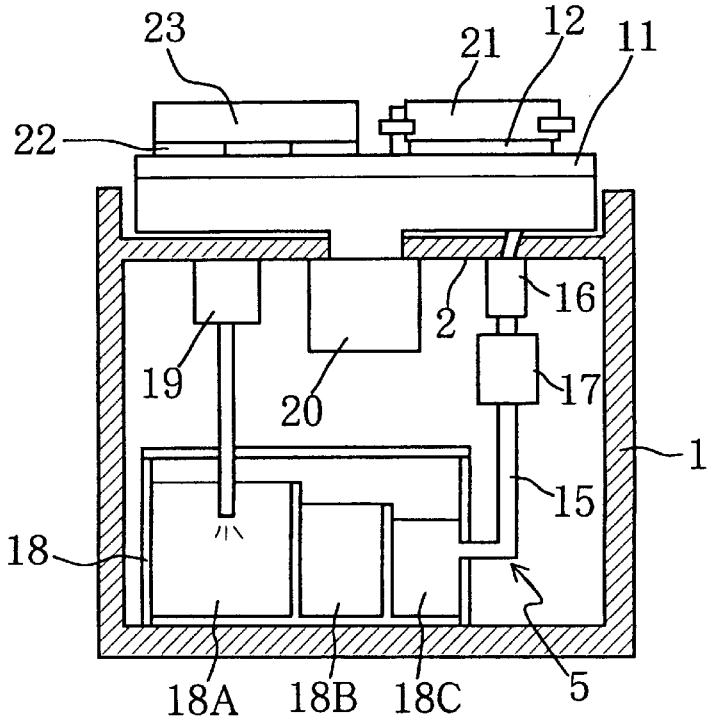
FIG. 2 is a side view of the same configuration as FIG. 1.

FIG. 1 is a plan view of a surface polishing apparatus of the first embodiment of the present invention, while FIG. 2 is its side view. As shown in these figures, an upper frame 2 of a frame 1 of the surface polishing apparatus is mounted thereon with a rotational disk-shaped polishing tool 11 with its processing surface facing upward. The polishing tool 11 is driven and rotated in a direction of an arrow A (clockwise as viewed from the top) by a motor 20.

A work piece 12 is pressed into contact with the processing surface of the polishing tool 11 by a pressure-application retainer plate 21. The pressure-application retainer plate 21 is on the work piece 12, which is in turn on the processing surface of the polishing tool 11. Therefore, both the pressure-application retainer plate 21 and the work piece 12 are held at the home position so that they can be rotated on their own axes, by a pair of support rollers of a horizontal frame 3 arranged on the forward side of the work piece 11 as against the rotation direction of the polishing tool 11.

Above the processing surface of the polishing tool 11, a box-shaped abrasive slurry-supply mechanism 13 and a box-shaped abrasive slurry-suction mechanism 14 are arranged and mounted with only a slight gap (1 mm or less) between these mechanisms and the processing surface. A dresser 23 is arranged and mounted on the processing surface to set the processing surface. The box-shaped abrasive slurry-supply mechanism 13 sprays abrasive slurry (for chemical mechanical polishing) through small-diameter pores in its bottom onto the processing surface, while the box-shaped abrasive slurry-suction mechanism 14 sucks and recycles abrasive slurry from the processing surface of the polishing tool 11 through small-diameter pores in its bottom.

The box-shaped abrasive slurry-supply mechanism 13 is arranged on the backward side (eg., upstream) of the work piece 12 with respect to the rotation direction of the polishing tool 11, while the dresser 23 is positioned on the forward side (e.g.) of the work piece 12 with respect to the rotation direction of the polishing tool 11. Moreover, the box-shaped abrasive slurry-suction mechanism 14 is provided on the forward side (e.g., downstream) of the dresser 23 and on the backward side (e.g., upstream) of the box-shaped abrasive slurry-supply mechanism 13 with respect to the rotation direction of the polishing tool 11, i.e. between the dresser 23 and the box-shaped abrasive slurry-supply mechanism 13. These three are all supported by the frame 1 so that they may cover the entire radial extent of the polishing tool 11, i.e., so that they may subject the entire radial extent of the polishing tool 11 to abrasive slurry supply, abrasive slurry suction, and setting respectively. As seen most clearly in FIG. 1, the disk-shaped polishing tool 11 rotates in order from the abrasive slurry-supply mechanism 13 to the work piece 12 to the dresser 23 and to the abrasive slurry-suction mechanism 14

Figure 3:
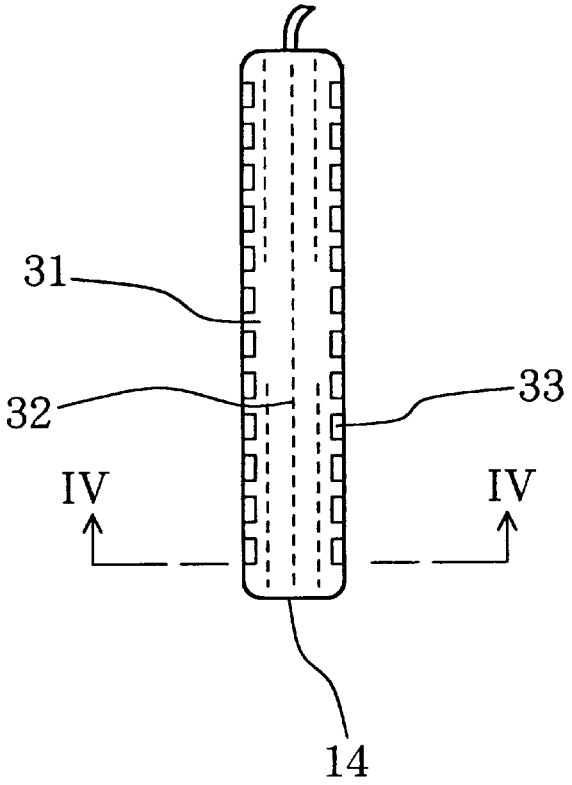
FIG. 3 is a bottom view of an abrasive slurry-suction mechanism of the same surface polishing apparatus as FIG. 1.
Figure 4:
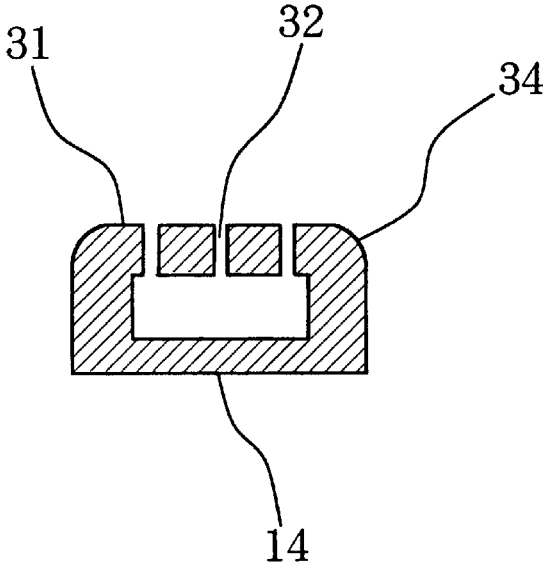
FIG. 4 is a cross-sectional view taken on line IV—IV in FIG. 3.

The box-shaped abrasive slurry-supply mechanism 13 has in its bottom a large number of small-diameter pores with a one-millimeter diameter and a three-millimeter pitch. The box-shaped abrasive slurry-suction mechanism 14, on the other hand, as shown in FIG. 3, has in its abrasive slurry-suction surface 31 facing the inner and outer peripheries of the polishing tool 11 a number abrasive slurry-suction pores 32 (with a one-millimeter diameter) as many as three times the number of those in the middle. Also, the abrasive slurry-suction mechanism 14 has a plurality of shallow trenches 33 with a depth of one-millimeter or less in a width-directional outer margin of the abrasive slurry-suction surface 31 facing the polishing tool 11. These shallow trenches 33, which are appropriately spaced from one another, are provided to capture abrasive slurry which tends to flow toward the outer periphery of the polishing tool by the centrifugal force. Moreover, as shown in FIG. 4, the box-shaped abrasive slurry-suction mechanism 14 has a rounding 34 (with about two millimeters of rounding radius) at the outer margin of the abrasive slurry-suction surface 31 facing the polishing tool 11. The rounding 34, which may be replaced with a chamfer, is provided to prevent damages if the abrasive slurry-suction mechanism 14 should come in contact with the processing surface.

The dresser 23, as shown in FIG. 1, has a plurality of small circle-shaped grindstones 22, each of which is a mixture of natural diamond grits (with a diameter of 150 microns) and artificial diamond grits (with a diameter of 100 microns), that are locked in a circle at the lower surface of a disk-shaped board 24. The dresser 23, like the work piece, is supported in pressure-contact with the processing surface by its own weight. The dresser 23 is on the processing surface of the polishing tool 11, to be held so as to rotate on its axis at its home position by means of a pair of support rollers 4 of a horizontal frame 3 arranged on the forward side of the work piece 12 as against the rotation direction of the polishing tool 11.

Below the upper frame 2 of the frame 1, a feedback-and-circulation circuit 5 is provided which feeds back abrasive slurry sucked and recycled by the box-shaped abrasive slurry-suction mechanism 14 and sends it to the box-shaped abrasive slurry-supply mechanism 13. The feedback-and-circulation circuit 5 comprises an abrasive slurry tank 18 and a filter 16 which filters abrasive slurry. The abrasive slurry tank 18 comprises a plurality of stages (three stages in this embodiment) of settling chambers 18A, 18B, and 18C to reserve therein recycled abrasive slurry and remove foreign matter by sedimentation and filtration while allowing an overflow of the recycled abrasive slurry to flow sequentially toward the downstream side. The settling chambers 18A, 18B, and 18C have sequentially different heights of bridge-walls so that an overflow of the recycled abrasive slurry may be allowed to flow from the upper-stream side to the lower-stream side sequentially.

The box-shaped abrasive slurry-suction mechanism 14 is connected via a pump 19 with a pipe 15 to the uppermost-stream side settling chamber 18A. The box-shaped abrasive slurry-supply mechanism 13 is connected via a pump 17 and the filter 16 with the pipe 15 to the lowermost-stream side settling chamber 18C. The pump 19 on the suction side is strong enough to suck abrasive slurry together with air from the box-shaped abrasive slurry-suction mechanism 14, which air is disposed so as not to enter the abrasive slurry tank 18 so much by a mechanism (not shown). The pump 17 on the supply side can discharge abrasive slurry at a rate of 100 ml/min approximately. The filter 16, having two stages of 50- micron and 10-micron meshes, is given to remove foreign matter which could not be caught at the settling chambers 18A, 18B, and 18C.

The actions are explained below.

Immediately after the polishing tool 11 starts processing, the box-shaped abrasive slurry-supply mechanism 13 supplies abrasive slurry to the processing surface. The abrasive slurry supplied onto the processing surface just before the work piece 12 reaches the processing position of the work piece 12 as the polishing tool 11 rotates. Then, as the polishing tool 11 and the work piece 12 rotate (in a direction indicated by an arrow B in FIG. 1), friction brought about between them by their respective rotations causes the work piece 12 to be polished.

The abrasive slurry, after passing through the work piece, is turned up from the processing surface of the polishing tool 11 by the setting of the polishing tool 11 conducted by the dresser 23 arranged on the downstream side and is then immediately sucked by the box-shaped abrasive slurry-suction mechanism 14.

At the same time, as the polishing tool 11 rotates, the dresser 23 is rotated on its axis in a direction indicated by an arrow C, so that the processing surface is set by its friction with the small diamond grindstones provided at the lower surface of the dresser 23. Since the dresser 23 is provided with small grindstones 22 each of which is a mixture of natural diamond grits (150 microns) and artificial diamond grits (100 microns), the effect of setting is increased by the sharpened portions of the cutting edges of these natural diamond grits. In addition, the mixing with artificial diamond grits is effective in lowering the cost of the dresser 23.

Since the dresser 23 is thus used to set the processing surface of the polishing tool 11, even when a higher processing pressure is applied onto the work piece 12, polish chips from the polishing tool's 11 surface and polishing tool chips can be turned up together with abrasive slurry and removed in process, to always keep the processing surface clean.

In addition, in a surface polishing apparatus according to the present embodiment, the box-shaped abrasive slurry-suction mechanism 14 has a triple number of abrasive slurry-suction pores 32 in the abrasive slurry-suction surface 31 facing the inner and outer peripheries of the polishing tool 11 as compared to those in the middle portion, so that abrasive slurry which tends to gather at the inner and outer peripheries of the polishing tool 11 can be sucked efficiently.

Moreover, the box-shaped abrasive slurry-suction mechanism 14 has a plurality of shallow trenches 33 with a depth of one millimeter or less in the outer margin of the abrasive slurry-suction surface 31 facing the polishing tool 11, so that abrasive slurry which tends to flow toward the outer periphery of the polishing tool 11 can be caught efficiently by these shallow trenches 33 provided in the outer margin of the abrasive slurry-suction surface 31.

Also, the box-shaped abrasive slurry-suction mechanism 14 has a rounding 34 at the outer margin of the abrasive slurry-suction surface 31 facing the polishing tool 11, so that it is possible to prevent damages of the polishing tool 11 and the box-shaped abrasive slurry-suction mechanism 14 even if they should come in contact with each other.

Thus, it is possible to efficiently polish work pieces for a long time without decreasing the polishing rate. At the same time, abrasive slurry is supplied to and recycled from the entire extent of the processing surface of the polishing tool 11, thereby enabling polishing under the same conditions irrespective of the size of the work piece 12.

Now, the results of testing are described specifically below.

In the test, a disk (with a diameter of 25 inches) made of polyurethane was used as the disk-shaped polishing tool 11 and colloidal silica (with a grit diameter of 100 Å) was used as abrasive slurry, to polish a wafer with $SiO_2$ films (work piece).

The test conducted with a polishing-tool rotating speed of 24 rpm and an application pressure of 600 g/cm$^2$ came up with a result that the polishing rate is 2200±50 Å/min within a polishing time of 20 hours, thus solving the conventional problem that a longer polishing time is required for a higher application pressure.

This effect is considered to be due to the fact that the box-shaped abrasive slurry-supply mechanism 13, the dresser 23, and the box-shaped abrasive slurry-suction mechanism 14 provided in the apparatus causes abrasive slurry supplied to the processing surface of the polishing tool 11 during polishing to be turned up, after being used to polish the work piece 12, and then immediately sucked by the box-shaped abrasive slurry-suction mechanism 14 to remove the polish chips from the processing surface of the polishing tool 11 and its own chips together with the abrasive slurry so that clean abrasive slurry after passing through the filter 16 may be supplied to the processing surface.

In the present embodiment, instead of allowing the dresser 23 to rotate on its own axis as the polishing tool 11 rotates, another rotary-drive mechanism may be used to force the dresser 23 to rotate. In this case, although the number of rotary-drive mechanism provided increases, it is possible to change the relative travel speed between the polishing tool 11 and the dresser 23 and also to rotate the polishing tool 11 in a direction opposite to the rotation direction of the polishing tool 11, to easily control the degree of setting appropriately.

SECOND EMBODIMENT

Now, the second embodiment of the present invention is described below.

Figure 5:
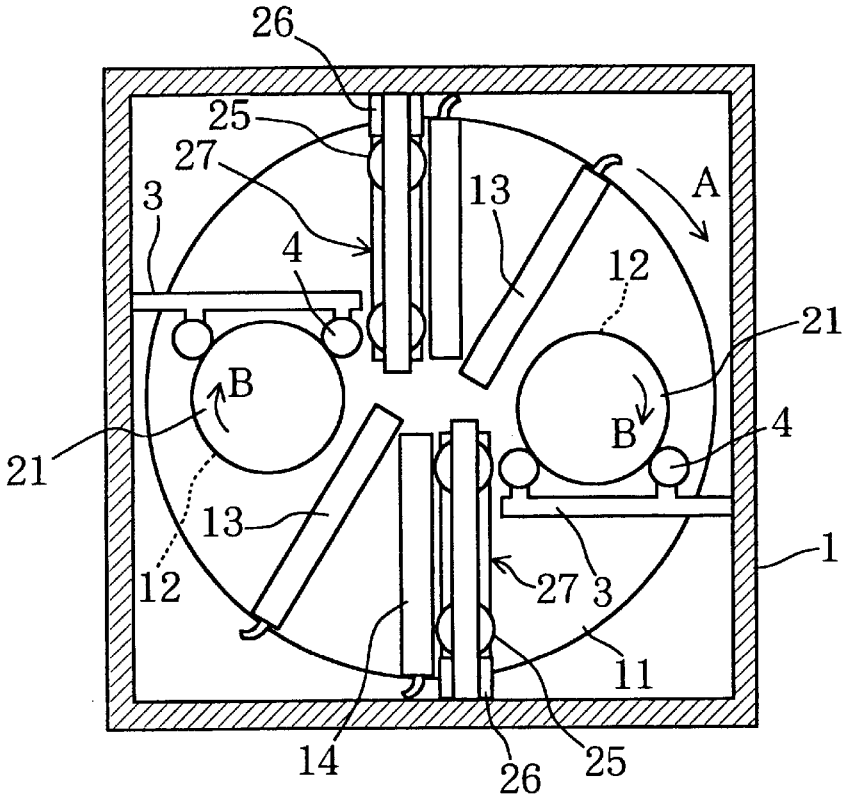
FIG. 5 is a plan view of the configuration of a surface polishing apparatus according to the second embodiment of the present invention.
Figure 6:
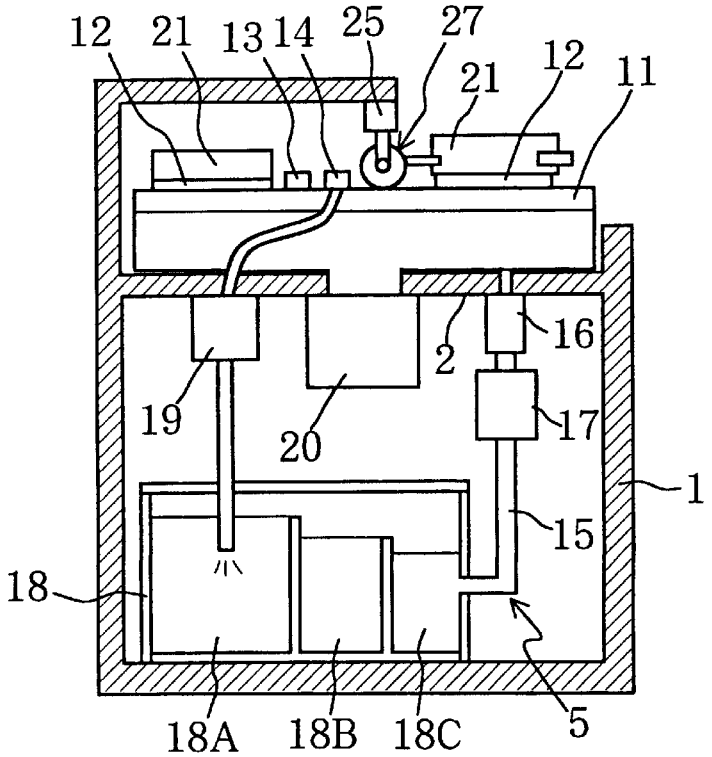
FIG. 6 is a side view of the same configuration as FIG. 5.

FIG. 5 is a plan view of a surface polishing apparatus according to the second embodiment of the present invention, while FIG. 6 is its side view. In the surface polishing apparatus according to the second embodiment, during polishing, two work pieces 12 are placed about the rotation center of a polishing tool 11 (FIG. 5).

Therefore, each of two box-shaped abrasive slurry-supply mechanisms 13 is arranged on the backward side in rotation of each of the two work pieces 12, while each of two box-shaped abrasive slurry-suction mechanisms 14 is arranged on the forward side of each of the two work pieces 12. Also, each of two dresser 27 is arranged between each box-shaped abrasive slurry-suction mechanism 14 and each work piece 12. As the dressers 27, cylinder-shaped diamond grindstones (roller-shaped grindstones) are employed for compacting. The other features of structure are the same as the first embodiment.

The dressers 27 comprise cylinder-shaped grindstones each of which is a mixture of natural diamond grits (with a diameter of 150 microns) and artificial diamond grits (with a diameter of 100 microns). The sharpened portions of the cutting edges of these natural diamond grits have setting effects, while the mixing with the artificial diamond grits serves to lower the cost of the dressers 27. The dressers 27 are made of cylinder-shaped diamond grits are arranged with their axes being approximately aligned with the axial direction of the polishing tool 11, so as to cover the entire radial extent of the polishing tool 11. Moreover, each of the cylinder-shaped dressers 27 is pressed, by two pressure-application cylinders (pressure-application mechanisms) 25 each of which is arranged at both axial ends, into contact with the processing surface of the polishing tool 11, so that each of the dressers 27 can be rotated by each of two motors 26 in a direction opposite to the rotation direction of the polishing tool 11.

Now, the actions are explained below.

Immediately after the polishing tool 11 starts processing, the box-shaped abrasive slurry-supply mechanism supplies abrasive slurry to the processing surface. The abrasive slurry is thus supplied onto the processing surface just in front of the work piece 12 and then reaches the processing position of the work piece 12 as the polishing tool 11 rotates, so that the work piece 12 is polished by its friction with the polishing tool 11 caused by its own rotation (indicated by an arrow B in FIG. 1) and the rotation of the polishing tool 11.

Abrasive slurry after being used in polishing passes through the work piece 12 and then is turned up, from the processing surface of the polishing tool 11, by the setting of the polishing tool 11 by the dresser 27 made of cylinder-shaped diamond grindstones (with a contact pressure of 10 g/cm$^2$) arranged on the downstream side of flow and then is immediately sucked by the box-shaped abrasive slurry-suction mechanism 14. Therefore, even when a high pressure is applied to the work piece 12, polish chips from the processing surface of the polishing tool 11 and its polish chips are turned up together with the abrasive slurry and removed in process, to always keep the processing surface clean.

Thus, a plurality of work pieces (two work pieces in the present embodiments) can be efficiently polished simultaneously for a long time without lowering the polishing rate. At the same time, abrasive slurry can be supplied all over the processing surface of polishing tool 11 and then recycled from the entire extent of the processing surface of the polishing tool after the processing surface is set, so that a plurality of work pieces can be polished at a time under the same conditions.

Now, the results of testing are described below specifically.

The test was also conducted under the same conditions as the above-mentioned first embodiment. The test came up with the result that the polishing rate is 2200±60 Å/min within an accumulated total polishing time of 20 hours, to solve the conventional problem that the polishing rate decreases with a high application pressure as the polishing time increases. Moreover, the number of work pieces that can be polished at a time can be doubled, thus improving the throughput.

Figure 7:
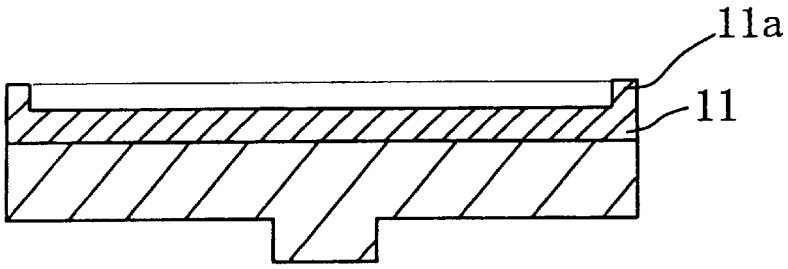
FIG. 7 is a sectional side elevation of another example of the polishing tool used in the embodiments of the present invention.
Figure 8:
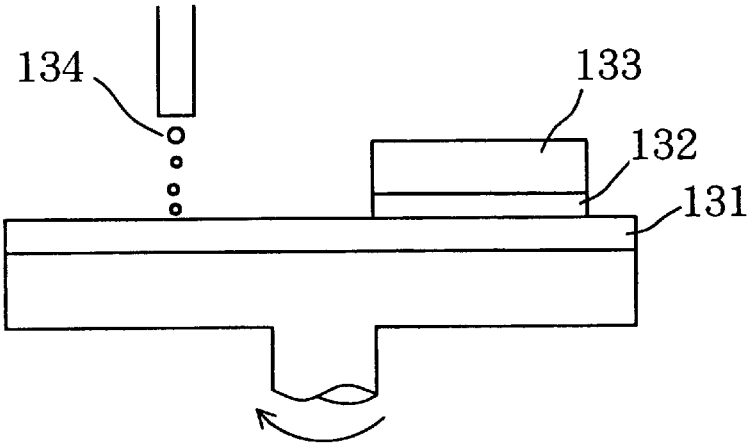
Fig. 8 (PRIOR ART)
FIG. 8 is a side view of a conventional surface polishing apparatus.
Figure 9:
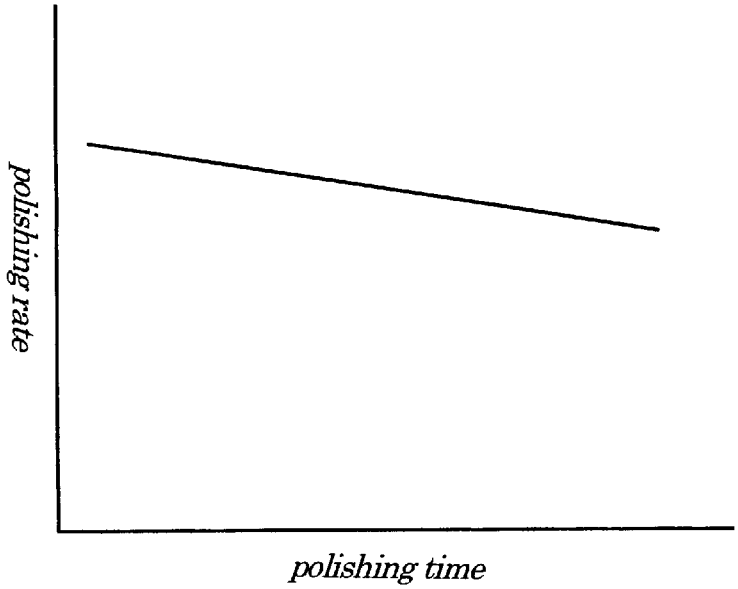
Fig. 9 (PRIOR ART)
FIG. 9 is a graph of the polishing rate by the conventional surface polishing apparatus.

Although the embodiments of the present invention have been detailed above with reference to the drawings, for example, as shown in FIG. 7, a rising wall 11a can be provided at the periphery of the processing surface of the polishing tool 11 to prevent abrasive slurry supplied onto the processing surface from draining out from it, thus further improving the efficiency of recycling abrasive slurry. Also, the work piece is not limited to a wafer with $SiO_2$ films, coming in, for example, a wafer with metal wirings, a magnetic disk, a glass substrate, and other plate-shaped pieces.

It is thus apparent that the present invention is not limited to the above embodiments but may be changed and modified without departing from the scope and spirit of the invention.

Finally, the present application claims the priority of Japanese Patent Application No. Hei9-239716 filed Sep. 4, 1997, which is herein incorporated by reference.

What is claimed is:

1. A surface polishing apparatus for polishing a surface of a work piece pressed into contact with a processing surface of a disk-shaped polishing tool of the surface polishing apparatus while rotating and supplying abrasive slurry to said processing surface, said surface polishing apparatus comprising in order:

an abrasive slurry-supply mechanism for supplying abrasive slurry to said processing surface of said disk-shaped polishing tool;

a dresser for setting said processing surface of said disk-shaped polishing tool; and an abrasive slurry-suction mechanism for sucking and collecting said abrasive slurry on said processing surface;

wherein said work piece is positioned between said abrasive slurry-supply mechanism and said dresser such that the abrasive slurry supplied by said abrasive slurry-supply mechanism contacts said dresser prior to being sucked by said abrasive slurry-suction mechanism;

wherein said abrasive slurry-suction mechanism comprises shallow trenches which capture abrasive slurry in an outer margin of an abrasive slurry-suction surface which faces said disk shaped polishing tool.

2. A surface polishing apparatus according to claim 1, wherein said abrasive slurry-supply mechanism, said abrasive slurry-suction mechanism, and said dresser subject an entire extent of a tool radius of said disk-shaped polishing tool to abrasive slurry supply, abrasive slurry suction, and setting respectively.

3. A surface polishing apparatus according to claim 1, wherein said abrasive slurry-suction mechanism comprises a larger number of abrasive slurry-suction pores in an abrasive slurry-suction surface which faces inner and outer peripheries of said disk-shaped polishing tool than in a middle portion between said inner periphery and said outer periphery.

4. A surface polishing apparatus according to claim 1, wherein said abrasive slurry-suction mechanism comprises a rounding or a chamfer at an outermost margin of an abrasive slurry-suction surface which faces said disk-shaped polishing tool.

5. A surface polishing apparatus according to claim 1, wherein said abrasive slurry-suction mechanism is further provided for sucking and recycling said abrasive slurry on said processing surface.

6. A surface polishing apparatus according to claims 1, wherein said dresser includes a plurality of small diamond grindstones each of which comprises a mixture of natural diamond and artificial diamond grits and which are locked in a circle on a disk-shaped board so that said plurality of small diamond grindstones are pressed and held in contact with said disk-shaped polishing tool to set a processing surface of said disk-shaped polishing tool by rotating said disk-shaped board.

7. A surface polishing apparatus according to claim 6, wherein said dresser is supported rotationally on said processing surface of said disk-shaped polishing tool, and is rotated on its axis at a home position by friction due to rotation of said disk-shaped polishing tool.

8. A surface polishing apparatus according to claim 6, wherein said dresser is forced to rotate on said processing surface of said disk-shaped polishing tool by a rotary-drive mechanism.

9. A surface polishing apparatus according to claim 1, wherein said dresser comprises cylinder-shaped diamond grindstones each of which has a mixture of natural diamond and artificial diamond grits, said cylinder-shaped diamond grindstones are arranged so that said cylinder-shaped diamond grindstones are aligned approximately with a radial direction of said disk-shaped polishing tool and, are held in contact with said processing surface of said disk-shaped polishing tool when being rotated in a direction opposite to a rotation direction of said disk-shaped polishing tool, to set said processing surface of said disk-shaped polishing tool.

10. A surface polishing apparatus according to claim 9, further comprising a pressure-application mechanism which presses said cylinder-shaped diamond grindstones into contact with said processing surface of said disk-shaped polishing tool is arranged at both axial ends of each of said cylinder-shaped diamond grindstones.

11. A surface polishing apparatus according to claim 1, wherein the abrasive slurry-suction mechanism is mounted to said processing surface of said polishing tool with approximately a 1 mm or less gap therebetween.

12. A surface polishing apparatus for polishing a surface of a work piece pressed into contact with a processing surface of a disk-shaped polishing tool of the surface polishing apparatus while rotating and supplying abrasive slurry to said processing surface, said surface polishing apparatus comprising:

an abrasive slurry-supply mechanism supplying abrasive slurry to said processing surface of said disk-shaped polishing tool positioned on an upstream side of said work piece in a rotational direction of said polishing tool;

a dresser for setting said processing surface of said disk-shaped polishing tool positioned immediately adjacent and on a downstream side of said work piece in the rotational direction of said polishing tool; and an abrasive slurry-suction mechanism sucking and collecting said abrasive slurry on said processing surface positioned on a downstream side of said work piece in the rotational direction of said dresser, wherein said abrasive slurry-suction mechanism comprises a rounding or a chamfer at an outermost margin of an abrasive slurry-suction surface which faces said disk shaped polishing tool;

wherein abrasive slurry supplied by said abrasive slurry-supply mechanism contacts said dresser prior to being sucked by said abrasive slurry-suction mechanism, and wherein said disk-shaped polishing tool rotates in order from said abrasive slurry-supply mechanism to said work piece to said dresser and to said abrasive slurry-suction mechanism.

13. A surface polishing apparatus comprising:

a disk-shaped polishing tool having a processing surface, the disk-shaped polishing tool being capable of rotating in a first direction;

a work piece mounting mechanism pressing a work piece into contact with the processing surface;

an abrasive slurry-supply mechanism supplying abrasive slurry to said processing surface of said disk-shaped polishing tool locating upstream from said work piece in relation the first direction of rotation;

a dresser setting said processing surface of said disk-shaped polishing tool, said dresser located immediately adjacent to and downstream from said workpiece in relation to the first direction of rotation; and an abrasive slurry-suction mechanism sucking and collecting said abrasive slurry on said processing surface located downstream from said abrasive slurry-suction mechanism in relation to the first direction of rotation, wherein said abrasive slurry-suction mechanism comprises a larger number of abrasive slurry-suction pores in an abrasive slurry-suction surface which faces inner and outer peripheries of said disk-shaped polishing tool than in a middle portion between said inner periphery and said outer periphery.

* * * * *